US005415199A

United States Patent [19]

Claudinon et al.

[11] Patent Number: 5,415,199

[45] Date of Patent: May 16, 1995

[54] UNIT FOR CONTROLLING A PLURALITY OF HYDRAULIC ACTUATORS

[75] Inventors: Jean-Louis Claudinon, Andrezieux-Boutheon; André Rousset, St. Priest en Jarrez, both of France

[73] Assignee: Marrel, France

[21] Appl. No.: 98,422

[22] Filed: Jul. 27, 1993

[30] Foreign Application Priority Data

Aug. 4, 1992 [FR] France ..... 92 09659

[51] Int. Cl.[6] ..... F15B 13/08

[52] U.S. Cl. ..... 137/596; 91/446; 91/512; 91/517

[58] Field of Search ..... 137/596.13, 596; 91/446, 512, 517

[56] References Cited

U.S. PATENT DOCUMENTS 3,987,622 10/1976 Johnson .
4,617,854 10/1986 Kropp .
4,736,770 4/1988 Rousset et al. .
4,981,159 1/1991 Christensen et al. ..... 137/596.13
5,152,140 10/1992 Hirata et al. ..... 91/446 X
5,222,426 6/1993 Marcon et al. ..... 91/446
5,251,444 10/1993 Ochiai et al. ..... 91/446 X

FOREIGN PATENT DOCUMENTS 0427865 5/1991 European Pat. Off. .
2339757 8/1977 France .
2548290 1/1985 France .
2562632 10/1985 France .
2587419 3/1987 France .
2350380 4/1975 Germany .

*Primary Examiner*—Gerald A. Michalsky
*Attorney, Agent, or Firm*—Remy J. VanOphem; John VanOphem

[57] ABSTRACT

Hydraulic actuators are fed by a single flow-rate generator, each being connected to it through a proportional directional valve, the unit including a device for detecting the highest of the pressures prevailing upstream of the throttle provided by a controlled spool in the respective proportional directional valves, and, in each of these an actuation device to cause the compensating spool to respond to the highest of the upstream pressures thus detected.

17 Claims, 4 Drawing Sheets

1
2
3
4
5
6
7
8
9
10
11
12
13
14
15
16
27
28
29
30
31
32
33
34
35
36
37
38
39
40
41
42
43
44
45
46
48
49
50
51
52
53
54
55
56
61
62
70
71
72
73
74
80
81
82
83
84
85
86
87
88
89
90
91
92
93
94
95
96
98
99
100
101
102
104

170
1
2
3
4
5
6
7
8
9
10
11
12
13
14
15
27
28
29
30
31
32
33
34
35
36
37
38
39
40
41
42
43
44
45
48
49
50
51
52
53
54
55
56
61
62
71
72
73
74
81
83
84
85
86
87
88
91
92
93
94
95
96
98
99
100
101
102
104
116
146
180
300
301
302
303
304
305
306
307
308
309
310
311
312
313
314
315

UNIT FOR CONTROLLING A PLURALITY OF HYDRAULIC ACTUATORS

BACKGROUND OF THE INVENTION

1. Field of the Invention

The invention relates to a unit for controlling a plurality of hydraulic actuators, through which the actuators are supplied by a single flow-rate generator, each being connected to it through a proportional directional valve.

2. Description of the Prior Art

It is known that directional valves are appliances which are disposed between a flow-rate generator and an actuator in order to control the functioning of the actuator by adapting the way in which it is connected to the flow-rate generator.

Directional valves of the proportional type have not only a controlled spool, the position of which determines the cross section of a throttle, but also an automatic compensating spool for keeping constant the pressure difference between the upstream and downstream of this throttle, so that a given flow-rate of fluid corresponds to a given position of the controlled spool. Consequently, when an actuator is controlled with a proportional directional valve, its speed of operation is determined by the position of the controlled spool, independently of the load which the actuator bears.

When the flow-rate generator is used for supplying a plurality of actuators, with a proportional directional valve corresponding to each of them, it may happen that the total flow-rate demanded by the actuators exceeds the maximum flow-rate which the flow-rate generator is able to supply. The respective compensating spools are then no longer able to maintain, in each of the directional valves, the pressure difference between the upstream and downstream of the throttle at the predetermined constant, so that the most heavily loaded actuators slow down or stop while the less heavily loaded ones are able to continue to operate.

In order to avoid such malfunctioning, it has already been proposed to use the regulation of the flow-rate generator according to the power demanded, which at the present time is provided for on the majority of hydraulic circuits where the flow-rate generator supplies a plurality of actuators. This regulation is achieved by providing load-detection means known as "load sensing", which refer back to the flow-rate generator the pressure of the most heavily loaded actuator, to which pressure the flow-rate generator responds by producing a service pressure equal to the load-sensing pressure increased by a constant. In reality, this constant is added for as long as the total flow-rate demand is less than that capable of being supplied but, in the event of excessive demand, the value added to the load-sensing pressure is smaller than the constant, and the higher the excessive flow-rate demand, the smaller the value. It is this reduction in the value added which is used in order to avoid the aforesaid malfunctioning.

French Pat. No. 2,339,757 proposes to act on the actuating pressure of the controlled spool in each of the proportional directional valves, by arranging for the actuating valves to be fed not directly from a pilot pump but rather with the interposing, between the pilot pump and the actuating valves, of an operating margin valve which varies the supply pressure for the control valves in the same way as the difference between the pressure of the flow-rate generator and the load-sensing pressure. As long as the flow-rate generator is operating normally, the supply pressure for the control valves remains constant, just as if these valves are supplied directly by the pilot pump. In the event of an excessive flow-rate demand, the supply pressure for the control valves will decrease as a function of the magnitude of the excessive demand, the actuating pressure of all the controlled spools will decrease in the same way, and consequently all the throttlings produced by the controlled spools will increase in the same way, with the result that each directional valve will have applied to it the same level of flow-rate reduction so that all the actuators will slow down, with preservation of their speed ratio.

French Pat. No. 2,548,290 proposes to arrive at the same result where the proportional directional valves have a compensating spool which is located upstream of the controlled spool, by acting on the means of actuating the compensating spool: it continues to be forced in the direction of closing by the pressure upstream of the controlled spool and in the direction of opening by the pressure downstream of the controlled spool, but a double pressure force is substituted for the conventional spring, respectively in the direction of closing by the load-sensing pressure and in the direction of opening by the pressure of the flow-rate generator. The difference in pressure between upstream and downstream of the throttle of the controlled spool thus depends on the difference between the pressure of the flow-rate generator and the load-sensing pressure, which leads to the aforesaid result.

The invention aims to obtain this same result, but with improved performance.

SUMMARY OF THE INVENTION

The invention proposes a unit for controlling a plurality of hydraulic actuators, through which the actuators are supplied by a single flow-rate generator, each being connected to the unit through a proportional directional valve. The proportional directional valve has a controlled spool, the position of which determines the cross section of a first throttle; a compensating spool for regulating the pressure difference between upstream and downstream of the first throttle by producing, upstream of the latter, a second throttle with an appropriate cross section; and means for actuating the compensating spool, in order to cause it automatically to adopt a position in which it produces the second throttle with an appropriate cross section, in response to several pressures acting respectively in the direction of opening and in the direction of closing.

The unit includes a device for detecting the highest of the pressures prevailing upstream of the first throttle in the respective proportional directional valves, and wherein in each of the latter the means for actuating the compensating spool cause it to respond to the highest of the upstream pressures thus detected.

According to the invention, a particularly rapid response time for the compensating spool is obtained, notably compared with the aforesaid state of the art, since the highest of the pressures upstream of the respective first throttles is higher than the load-sensing pressure.

According to a first preferred embodiment of the invention, in each directional valve, the means for actuating the compensating spool are designed so that it is forced in the direction of opening by the pressure downstream of the first throttle and by the pressure upstream of the second throttle; and in the direction of closing by the pressure upstream of the first throttle, by the highest of the pressures upstream of the respective first throttles, and by a substantially constant force.

The assembly is thus suitable for use with a flow-rate generator producing a service pressure normally equal to a regulating pressure applied to it, referred to as the load-sensing pressure, increased by a constant.

It will be noted that it is essential that, in each directional valve, a force be applied to the compensating spool in the direction of closing; this force makes it possible to close the compensating spool completely when the excessive flow-rate demand is too great for all the speed ratios between the actuators to be maintained, which means that all the actuators are then stopped (there is no flow when the compensating spool is closed).

Preferably, the means of actuating the compensating spool include: on the latter, a first active surface subjected to the pressure downstream of the first throttle, a second active surface subjected to the pressure upstream of the second throttle, a third active surface subjected to the pressure upstream of the first throttle, and a fourth active surface subjected to the highest of the pressures upstream of the respective first throttles, the first and second surfaces being opposite the third and fourth surfaces; together with a spring forcing the compensating spool in the direction of closing.

According to a second preferred embodiment, the assembly also has at least one auxiliary valve fed by the flow-rate generator and producing a pressure which is normally equal to the highest of the pressures upstream of the respective first throttles increased by a constant. Further, in each proportional directional valve the means for actuating the compensating spool are designed so that it is forced in the direction of opening by the pressure downstream of the first throttle and by the pressure produced by a so-called auxiliary valve; and in the direction of closing by the pressure upstream of the first throttle, by the highest of the pressures upstream of the respective first throttles, and by a substantially constant force.

This second embodiment is distinguished from the first by the presence of the auxiliary valve, the pressure produced in which is applied instead of the pressure upstream of the second throttle. This makes it possible to avoid the difficulties which occur when the pressure upstream of the second throttle is not the same in the respective directional valves, as a consequence of different head losses between the flow-rate generator and the respective directional valves.

In addition, this embodiment offers the advantage of being able to provide the result sought even if the flow-rate generator is not regulated as a function of the load borne by the actuators.

Preferably, in each proportional directional valve, the means for actuating the compensating spool include on the latter a first active surface subjected to the pressure downstream of the first throttle, a second active surface subjected to the pressure produced by the auxiliary valve, a third active surface subjected to the pressure upstream of the first throttle, and a fourth active surface subjected to the highest of the pressures upstream of the first respective throttles, the first and second surfaces being opposite the third and fourth surfaces; together with a spring forcing the compensating spool in the direction of closing.

Preferably, for reasons of simplification, the first and third active surfaces of the compensating spool have similar sizes, and the second and fourth surfaces of the compensating spool have similar sizes.

Preferably, the auxiliary valve has:

an inlet chamber connected to the flow-rate generator;

a regulating chamber in which the highest of the pressures upstream of the respective first throttles prevails;

an outlet chamber in which the pressure produced prevails;

a spool, the position of which determines the cross section of a throttle between the inlet chamber and outlet chamber, having a first active surface disposed in the regulating chamber so that the highest of the pressures upstream of the respective first throttles acts in the direction of opening, and a second active surface disposed in the outlet chamber so that the pressure produced acts in the direction of closing; and a spring, which acts on the spool in the direction of opening.

where the proportional directional valves are divided into several groups in a directional valve or several adjacent directional valves, the groups being distant from each other, it is preferable for the unit to have, for each group, one so-called auxiliary valve adjacent to the group.

In this way the problems related to line head losses are avoided, and in particular it is not necessary to have to provide a line between the auxiliary valve and a group of directional valves at some distance from the latter.

Preferably, in each proportional directional valve there is no non-return valve between the second throttle and first throttle.

In fact, the invention, at least in the two embodiments set out above, makes the non-return valve provided in all the prior proportional directional valves unnecessary. This results from the fact that it is certain that, at rest (when all the controlled spools are in the neutral position), all the compensating spools are closed. If stock is taken of all the forces which are applied in the direction of closing and those which are applied in the direction of opening, taking account of the fact that, at rest, the pressure downstream of each compensating spool is equal to the upstream pressure (even if the compensating spool is closed because of the inevitable minute leakages), it can be seen that the forces which are applied in the direction of closing are always greater than those applied in the direction of opening.

According to preferred characteristics of the invention, the means for detecting the highest of the pressures upstream of the respective first throttles include a common conduit closed at a first end and opening out into the reservoir through a restriction at a second end; and for each proportional directional valve a non-return valve disposed so as to pass fluid between the upstream of the first throttle and the common conduit.

These characteristics are in fact favorable with regard to the speed of response of the compensating spools.

The disclosure of the invention will now be continued with a description of example embodiments, given below by way of illustration and non-limitatively, with reference to the accompanying drawings.

DETAILED DESCRIPTION OF THE PREFERRED EMBODIMENT

Figure 1:
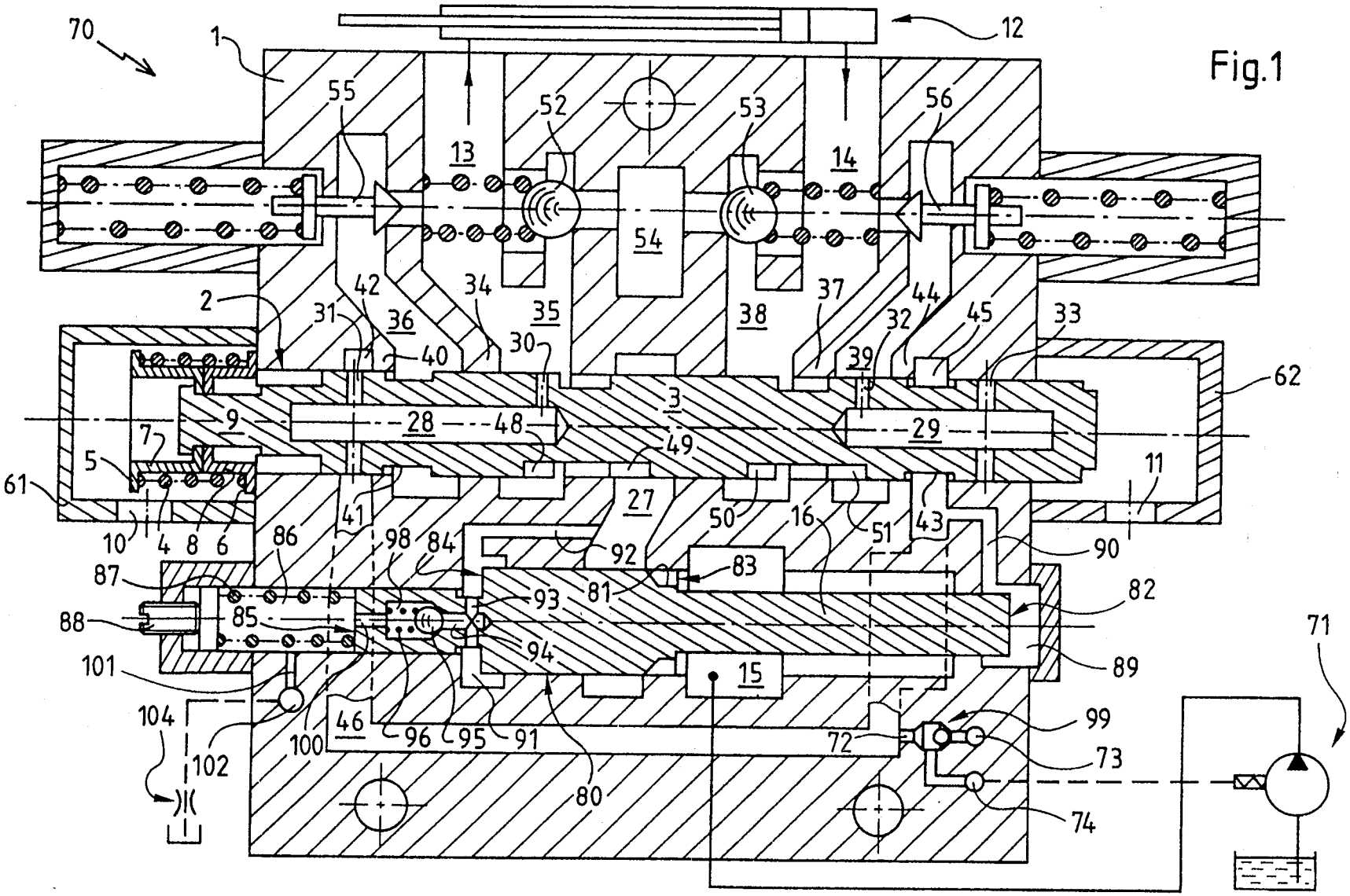
FIG. 1 is a diagrammatic view in cross section of a proportional directional valve forming part of a unit according to the invention.

A directional valve 70 according to the present invention, as illustrated in FIG. 1, is similar to the one described in French Pat. No. 2,562,632, with the exception of its pressure-compensating device.

It has a stator block 1, in a bore 2 of which slides a cylindrical controlled spool 3. As is usual, the hydraulic circuits are switched by a movement of the grooves of the spool 3 in front of the stator ports.

At its left-hand end, for example, the spool 3 has a spring return device of a known type, for example a helical spring 4, compressed between shoulders 5 and 6 of two rings 7 and 8, captive between two shoulders on an end 9 of the spool 3, about which they are able to slide. Thus the spool 3 is spontaneously returned to a neutral position of rest, while it is pushed to the right (FIG. 1) when a pilot pressure is directed into an opening 10 in a fixed cap 61. On the other hand, it is pushed towards the left when a pilot pressure is directed in the opposite direction, into an opening 11 in a cap 62 at its other end. In the example illustrated, it has been assumed that the three-position spool 3 is used to provide control of a double-acting hydraulic cylinder 12. For this purpose, one of the sections of the cylinder 12 is connected to a first utilization duct or conduit 13 in the stator block 1, while the opposite section of the cylinder 12 is connected to a second utilization conduit 14 in the stator block 1.

The directional valve receives, in an annular inlet chamber 15, the pressure sent by a flow-rate generator 71.

The inlet chamber 15 surrounds a compensating spool 16, also referred to as a balance spool, which is able to move in a bore 80 in the stator block 1, and which has a groove 81 which produces, depending on the position of the spool 16, throttling of varying degree between the chamber 15 and an annular chamber 27 surrounding the central part of the controlled spool 3.

At each of its two ends, the controlled spool 3 has an internal axial space, 28 to the left, 29 to the right.

The space 28 communicates with the exterior of the spool through two radial drillings or passages given the reference numerals 30 and 31, respectively. Likewise, the space 29 opens out onto two radial drillings or passages 32 and 33.

When the spool 3 is in its neutral position of rest, the drilling 30 is opposite a solid part 34 of the stator, which closes it off, between two annular chambers 35 and 36. The chamber 35 communicates with the first utilization conduit 13, while the chamber 36 is connected to the return circuit.

Likewise, the drilling 32 is closed off at rest, by a solid part 37, situated between two annular chambers 38 and 39. The chamber 38 communicates with the second utilization conduit 14, while the chamber 39 is connected to the return circuit.

Between the drillings 30 and 31, the stator defines, in the bore, a solid part 40, in front of which a groove 41 in the spool 3 is able to move.

Around the spool 3, in the zone situated around the drilling 31 when the spool is pushed to the right (FIG. 1), there is an annular stator chamber 42.

Likewise, at its opposite end, the spool 3 has a groove 43 moving in front of a solid part 44 of the stator. Around the passage 33, when the spool 3 is pushed towards the left, there is an annular stator chamber 45.

The two chambers 42 and 45 are connected by a conduit 46 referred to as the load-sensing conduit.

The various grooves in the spool are provided with progressiveness notches or grooves, as indicated for example by the reference numerals 48, 49, 50, 51.

Finally, a first prefill valve 52 is mounted in parallel with the first utilization conduit 13. Likewise, a prefill valve 53 is mounted in parallel with the second utilization conduit 14. Behind the valves 52 and 53 is a chamber 54 connected to the oil return circuit.

A pressure relief valve, respectively 55 and 56, is provided on the side of each of the utilization conduits 13 and 14, which are thus able to overflow into the return chambers, respectively 36 and 39.

The operation of the controlled spool 3 will now be described.

In the neutral position, the chambers 27, 35 and 38 are closed off, so that the cylinder 12 is immobilized while no flow is passing in the directional valve. In addition, the conduit 46 communicates, through the grooves 41 and 43 respectively, with the chamber 36 and chamber 39, that it to say it is connected to the return circuit.

When a pilot pressure is directed through the opening 10, as is the case in FIG. 1, the spool 3 slides to the right with an amplitude determined by the value of the pilot pressure, which is balanced with the opposing thrust of the spring 4, which is compressed to a greater or lesser degree. The feed pressure of the chamber 27 is directed into the first utilization conduit 13, passing through the groove 49 and chamber 35, while the second utilization conduit 14 communicates with the return chamber 39 through the groove 51. Each of the grooves 49 and 51 determines a throttle, the cross section of which is determined by the position of the spool 3. In addition, the conduit 46 communicates to the left with the first utilization conduit 13 through the passages 31, 28 and 30, while to the right it is closed off. The pressure downstream of the throttle produced by the groove 49 is thus transmitted to the conduit 46.

When a pilot pressure is directed through the opening 11, the spool 3 slides towards the left as far as a position determined by the amplitude of the pilot pressure. The feed pressure of the chamber 27 is directed into the second utilization conduit 14, passing through the groove 50 and chamber 38, while the first utilization conduit 13 communicates with the return chamber 36, passing through the groove 48. Each of the grooves 48 and 50 determines a throttle, the cross section of which is determined by the position of the spool 3. In addition, the conduit 46 communicates to the right with the second utilization conduit 14 through the drillings 33, 29 and 32, while to the left it is closed off. The pressure downstream of the throttle produced by the groove 50 is thus transmitted to the conduit 46.

It can thus be seen that, in the neutral position, the conduit 46 is subjected to the pressure of the return circuit, while in each of the operating positions it is raised to the pressure downstream of the throttle produced by the spool 3 on the supply line to the cylinder 12, that is to say to the utilization pressure of the latter.

One of the inlets to a circuit selector 99 (also referred to as the OR function) communicates with the conduit 46 through a duct 72, and its other inlet communicates with a duct 73 connected to the outlet conduit from the circuit selector of a similar directional valve. In this case, the pressure in the conduit 46 is the strongest, so that the circuit selector 99 adopts the position illustrated, in which it transmits, through its outlet to a conduit 74, the utilization pressure of the cylinder 12, which is the highest utilization pressure of all the actuators fed by the flow-rate generator 71. More generally, as can be seen clearly in FIG. 2, it is always the pressure of the most heavily loaded actuator which is applied to the conduit 74, this so-called load-sensing pressure being transmitted to the flow-rate generator 71, which produces a service pressure which is normally equal to the load-sensing pressure increased by a constant.

In the position illustrated in FIG. 1, the compensating spool 16 closes off the passage between the chambers 15 and 27, but when it moves to the left it produces, depending on its position, a throttling of varying degrees upstream of the throttle produced by the spool 3 on the line feeding the cylinder 12.

The spool 16 has a first active surface 82 subjected to the pressure downstream of the throttle produced by the spool 3, a second active surface 83 subjected to the pressure upstream of the throttle produced by the spool 16, a third active surface 84 subjected to the pressure upstream of the throttle produced by the spool 3, and a fourth active surface 85 subjected to the pressure prevailing in a chamber 86 situated to the left of the spool 16.

The surfaces 82 and 83 face towards the right, and are opposite the surfaces 84 and 85 which face towards the left. Since the spool 16 closes off the throttle which it produces when it moves from left to right and vice-versa, the pressures to which the surfaces 82 and 83 are subjected force the spool 16 in the direction of opening, while the pressures to which the surfaces 84 and 85 are subjected force it in the direction of closing. A spring 87 is provided in the chamber 86 between the end of the latter, situated to the left, and the surface 85, which means that the spool 16 is also forced in the direction of closing by a substantially constant force. In order to regulate the latter, a screw 88 is provided which forms the end of the chamber 86.

The surface 82 is subjected to the pressure prevailing downstream of the throttle produced by the spool 3 since it is disposed in a chamber 89 communicating with the conduit 46 through a duct 90, and the surface 84 is subjected to the pressure prevailing upstream of the throttle produced by the spool 3 since it is disposed in a chamber 91 communicating with the chamber 27 through a duct 92.

The spool 16 has a radial drilling 93 communicating with a blind axial drilling 94, which opens out onto a seat able to be closed off or unblocked by a ball 95, a return spring 96 for which is compressed in a chamber 98, which opens out through an axial opening 100 into the chamber 86. The chamber 86 communicates, through a passage 101, with a conduit 102 closed at one end and opening out into the reservoir of the flow-rate generator through a restriction 104 at the other end, the conduit 102 being common to all the directional valves, the chambers of which correspond to 86, which is connected thereto.

Figure 2:
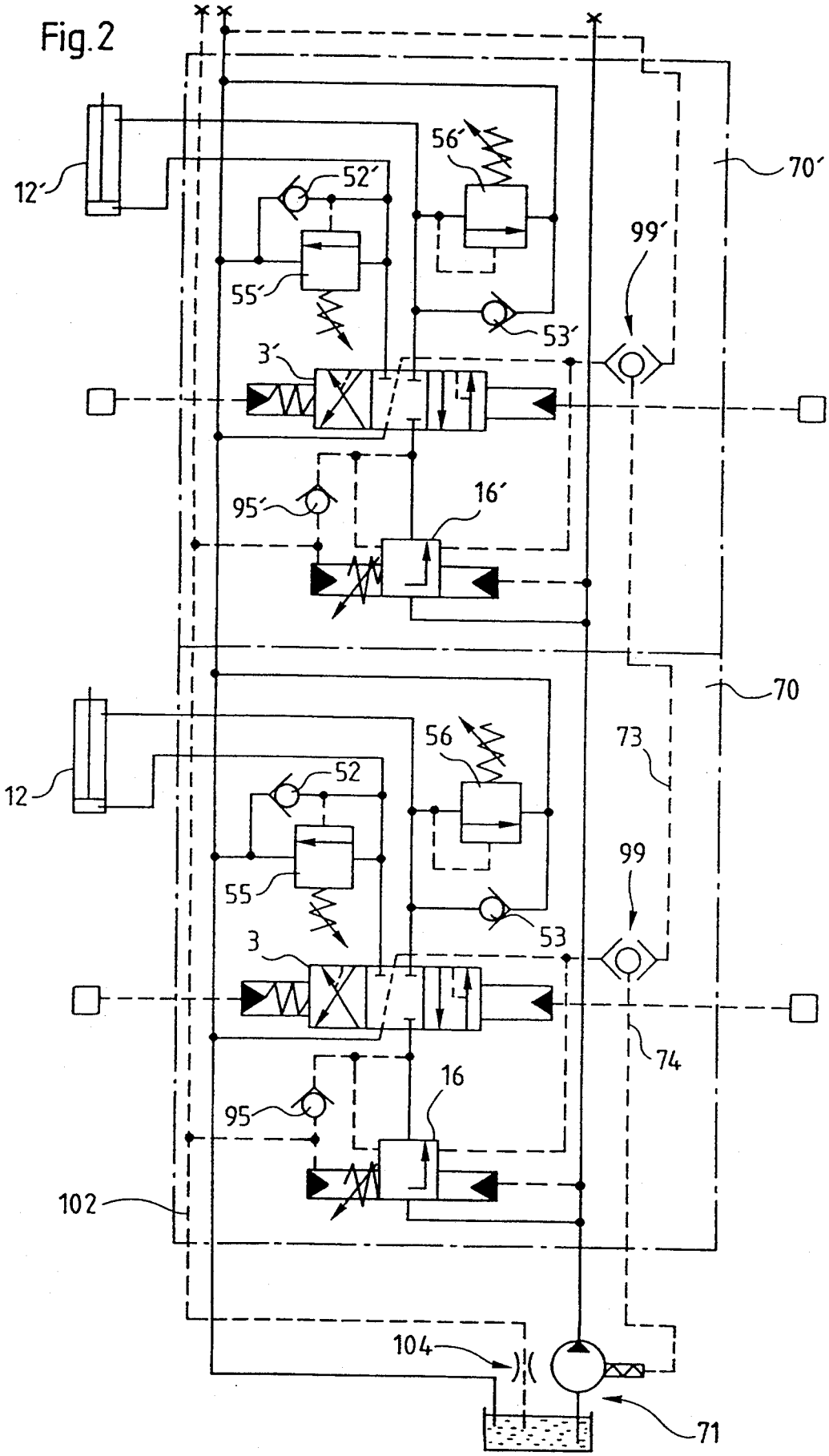
FIG. 2 is a diagram of a hydraulic circuit embodying the control unit, which includes two directional valves similar to the one shown in FIG. 1, joined end to end.

FIG. 2 shows a control unit according to the invention, formed by a single group of two directional valves joined together, respectively the directional valve 70 illustrated in FIG. 1 and an identical directional valve 70', all the components of the directional valve 70' bearing the same reference numerals as the directional valve 70 but given a prime suffix.

It can be seen that, for each directional valve 70 and 70' the common conduit 102 is connected to the upstream of the throttle produced by the spool 3 through a non-return valve, which is closed off by the ball 95, this non-return valve passing fluid towards the conduit 102. Consequently in the latter prevails the highest of the pressures prevailing upstream of the throttles produced by the spools 3 and 3', the restriction 104 producing a pressure drop in the duct 102, which allows continuous adjustment of this to the highest of the pressures upstream of the spools 3 and 3'. It is therefore the latter pressure which prevails in the chamber 86 and in the corresponding chamber 86 of the directional valve 70'.

In the example illustrated, the surfaces 82 and 84 have a similar size, termed $S_2$, and the surfaces 83 and 85 have a similar size, termed $S_1$. If in addition the force applied by the spring 87 is termed F, the pressure prevailing upstream of the throttle produced by the controlled spool 3 is termed $P_i$, the highest of the pressures prevailing upstream of the throttle produced by the controlled spools is termed $MAX(P_i)$, the pressure prevailing downstream of the throttle produced by the controlled spool 3 is termed $PU_i$, and the pressure prevailing upstream of the throttle produced by the compensating spool 16 is termed P, it can be demonstrated that at equilibrium:

$$P_i - PU_i = \frac{S_1}{S_2}[P - MAX(P_i)] - \frac{F}{S_2}$$

It can be seen that the pressure difference $P_i - PU_i$ depends on the pressure difference $P - MAX(P_i)$ in accordance with a linear function with a strictly positive coefficient and strictly negative constant.

Because of the way in which the flow-rate generator is regulated, the pressure difference $P - MAX(P_i)$ remains constant for as long as the flow-rate generator is able to meet the total flow-rate demand, while it is less than this constant when there is an excessive flow-rate demand, and the greater the excessive demand, the greater the decrease.

The values $S_1$, $S_2$ and F are chosen notably as a function of the following essential requirements:

the spool 16 must provide, in normal service, where $P - MAX(P_i) = a$, a value b at $P_i - PU_i$, such that:

$$b = \frac{S_1}{S2} a - \frac{F}{S2}$$

the spool 16 must close at a certain minimum value c of $P - MAX(P_i)$, beyond which it is considered that the overload is too great for the speed ratios between the actuators to be maintained, such that:

$$S_1.c = F.$$

It will be noted that there is no non-return valve in the directional valve 70 between the chambers 15 and 27, unlike conventional proportional directional valves in which a non-return valve is always provided, disposed so as to pass fluid between the throttle produced by the compensating spool and the one produced by the controlled spool.

In fact, in the control unit, it is certain that, at rest, when all the controlled spools 3 are in the neutral position, that all the compensating spools 16 are in the closed position illustrated: if the same notations are kept as before observing that, at rest, $P_i=P$ in all directional valves, even if the spool 16 is closed because of the minute leaks between the upstream and downstream of the latter which are inevitable, it can be seen that the spool 16 is forced in the direction of closing by:

$$F+P.S_1+P.S_2$$

and in the direction of opening by:

$$P.S_1.$$

Given that $F+P.S_2$ is strictly positive, it can be certain that the forces acting in the direction of closing will always be greater than those acting in the direction of opening.

In a variant (not illustrated) of the invention, use is made of the pressure $MAX(P_i)$ prevailing in the conduit 102 in order to regulate the flow-rate generator, instead of the load-sensing pressure prevailing in the conduit 74. This variant is of less advantage than the one illustrated, since it is less easy to regulate a flow-rate generator when the difference between the regulating pressure and service pressure becomes smaller.

In other variants which are not illustrated, the detection of the load-sensing pressure with circuit selectors is replaced by detection with non-return valves, or the detection of $MAX(P_i)$ with non-return valves by detection with circuit selectors.

It is clear, however, that the solution illustrated, in which the load-sensing pressure is detected by circuit selectors while $MAX(P_i)$ is detected by non-return valves, is preferable, since it is desirable to have rapid response times for the compensating spool 16 (in order to react quickly to any load variations), while it is better to have slower response times for regulating the flow-rate generator (in order to avoid ceaseless changes in the operation of the latter).

It will be noted that the conduits 73 and 74 form, with the selector 99, an assembly which passes right through the directional valve 70, and that the same applies to the conduit 102, so that there is a facility for making connections between directional valves, simply by joining the latter end-to-end, which is moreover illustrated completely in FIG. 2.

Figure 3:
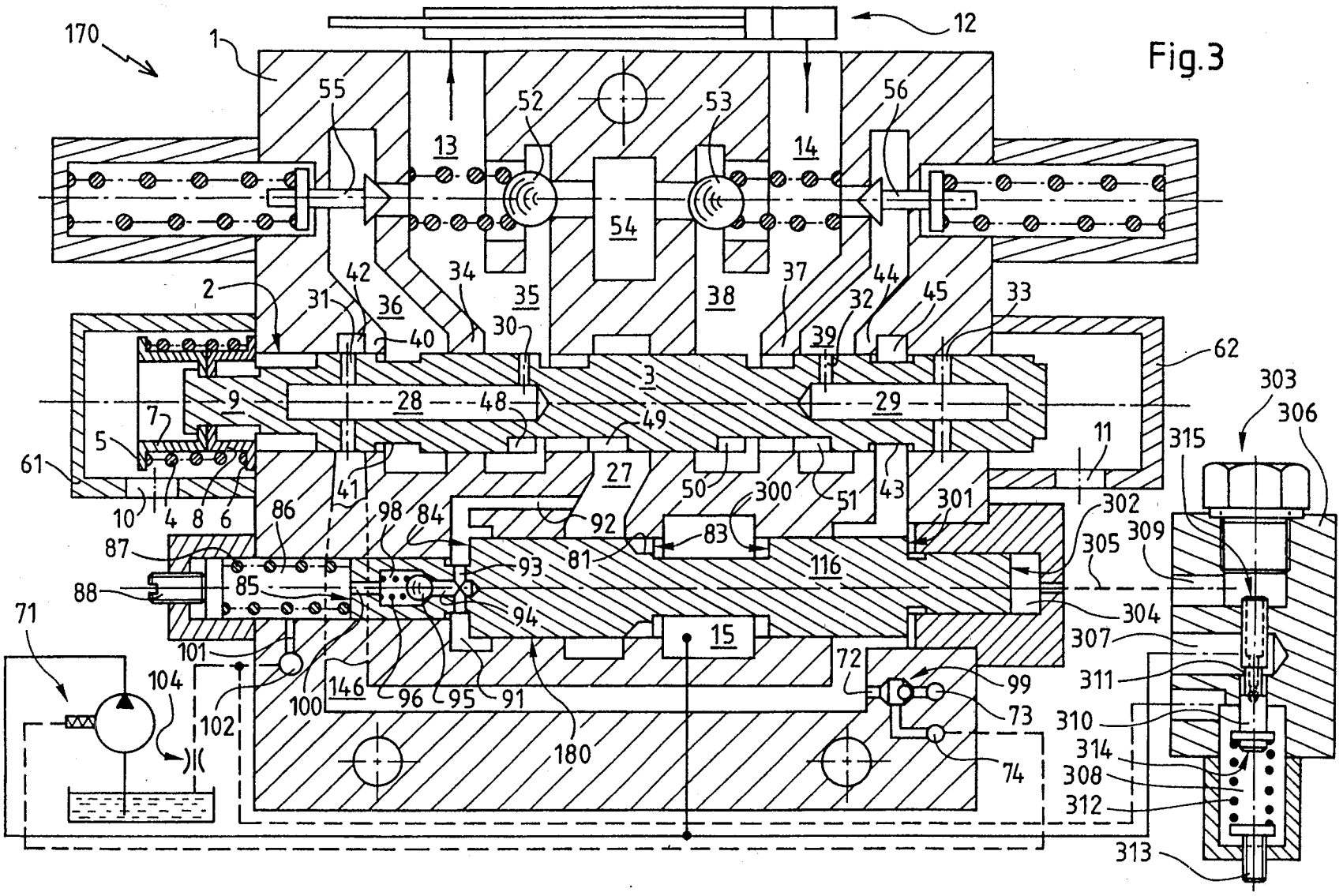
FIGS. 3 and 4 are similar to FIGS. 1 and 2, respectively, but illustrate an alternate embodiment.
Figure 4:
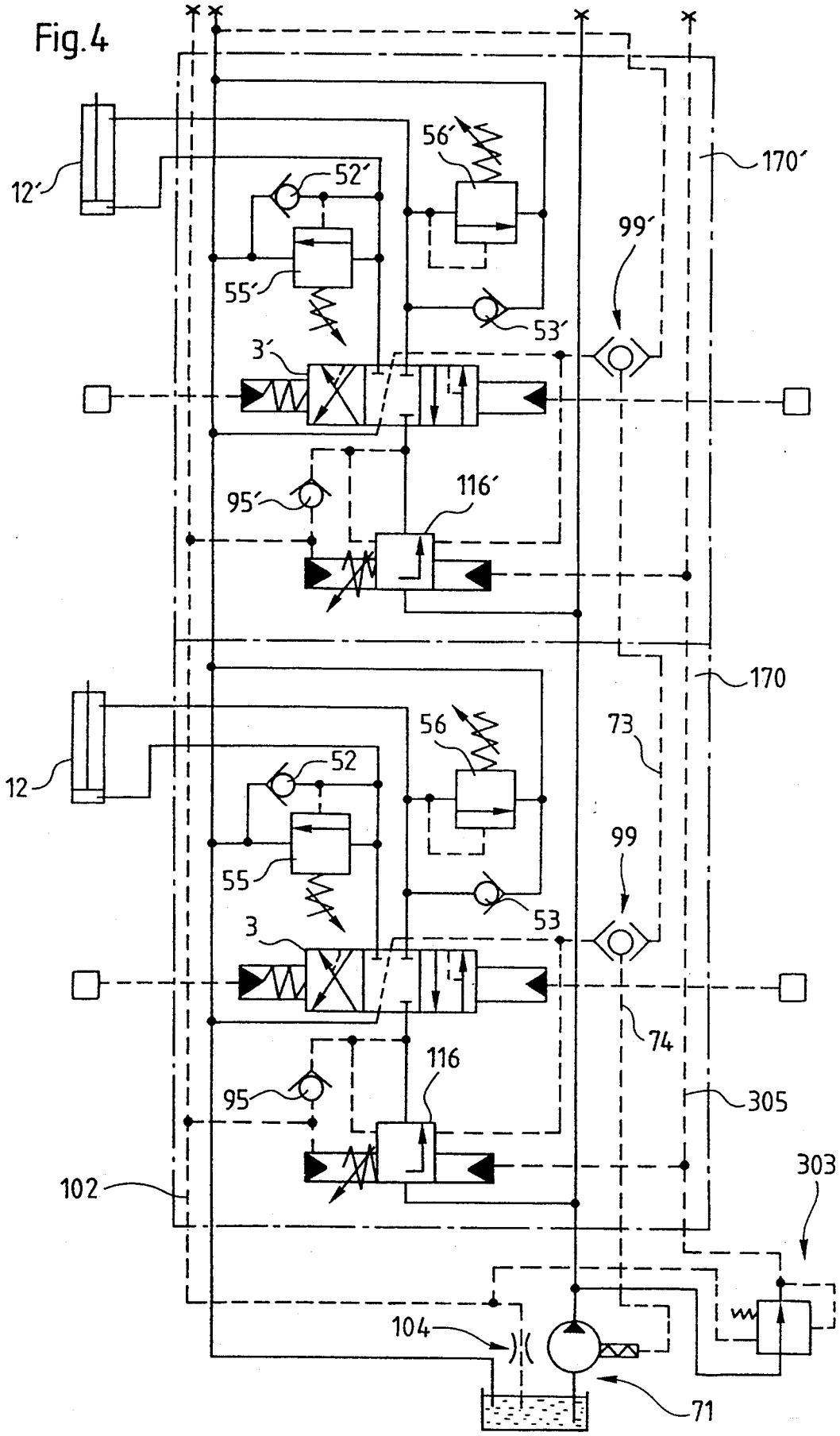

In the variant of the control unit according to the invention shown in FIGS. 3 and 4, the same reference numerals have been kept for identical components while the number 100 has been added to them for similar components.

The proportional directional valve 170 shown in FIG. 3 has a compensating spool 116, the right-hand part of which is different from the right-hand part of the spool 16: it has, opposite the active surface 83, an active surface 300 having the same effective area, that is to say $S_1$, another active surface 301 is subjected to the pressure downstream of the throttle produced by the spool 3, and yet another active surface 302 is subjected to the pressure produced by an auxiliary valve 303.

The surfaces 301 and 302 face towards the right, and are therefore opposite the surfaces 84 and 85, the pressures to which they are subjected therefore forcing the spool 116 in the direction of opening.

The surface 301 is subjected to the pressure prevailing downstream of the throttle produced by the spool 3 since it is disposed in the conduit 146, and the surface 302 is subjected to the pressure produced by the valve 303 since it is disposed in a chamber 304 connected to the valve 303 by a conduit 305.

The active surface 301 has an effective area similar to that of the surface 84, that is to say $S_2$, and the surface 304 has an effective area similar to that of the surface 85, that is to say $S_1$.

Given that the surfaces 83 and 300 also have a similar size, the pressure prevailing in the chamber 15 has no effect on the position adopted by the spool 116.

Because of the arrangement and sizing of the surfaces 301 and 302, the action of the pressure upstream of the throttle produced by the compensating spool has in fact been replaced by the action of the pressure produced by the auxiliary valve 303.

Provided that the corresponding change in notation is effected, the equations given above therefore apply to the alternate embodiment shown in FIGS. 3 and 4.

The auxiliary valve 303 has a stator body 306, which defines an inlet chamber 307 connected to the discharge orifice of the flow-rate generator 71; a regulating chamber 308, in which $MAX(P_i)$ prevails; an outlet chamber 309 in which the pressure produced prevails; a spool 310, the position of which determines, by virtue of a groove 311, the cross section of a throttle between the chambers 307 and 309; and a spring 312 which acts on the spool 310 in the direction of opening, a screw 313 being provided for regulating the force with which the spring acts.

$MAX(P_i)$ prevails in the chamber 308 since this chamber is connected to the conduit 102. The spool 310 has a first active surface 314 disposed in the chamber 308 and therefore subjected, in the direction of opening, to $MAX(P_i)$, and a second active surface 315 disposed in the chamber 309, which means that the pressure produced acts on the surface 315 in the direction of closing.

It can be demonstrated, where the effective area of the surfaces 314 and 315 is similar, and if this area is termed S, the pressure produced is termed $P_p$ and the force exerted by the spring is termed F, that this gives:

$$P_p = MAX(P_i) + \frac{F}{S}$$

The pressure produced is therefore independent of the pressure supplied by the flow-rate generator, which makes it possible to avoid the difficulties which could be encountered in the embodiment in FIGS. 1 and 2 due to the fact that there might be, in some proportional directional valves, different pressures upstream of the throttle produced by the compensating spool, notably where these directional valves are situated at a different distance from the flow-rate generator, and that there are therefore different head losses between the outlet pressure from the flow-rate generator and the pressure prevailing in the annular inlet chamber bearing the reference numeral 15.

Where the proportional directional valves in the control unit are divided into several groups of one directional valve or several adjacent directional valves, the groups being distant from each other, for example in the case of a civil engineering machine, divided into a first group of two directional valves controlling the right and left-hand forward-travel motors of the vehicle, a second group of a single directional valve controlling the rotation of a turret, and a third group of several directional valves controlling the different arms of the machine, it is preferable to provide an auxiliary valve for each of the groups, not only in order to avoid the problems of head loss but also to avoid having to provide a conduit between a centralized auxiliary valve and the different groups.

The speed ratios between actuators are kept similar to the case of the unit shown in FIGS. 1 and 2 since, in the event of excessive flow-rate demand, the inlet chamber 307 is not supplied at sufficient pressure for F/S to be added to MAX($P_i$), it is only a lower value which is added, and the greater the excessive flow-rate demand, the smaller is this value.

It will be noted that the various remarks made with regard to the embodiment in FIGS. 1 and 2, and particularly the one relating to the possible variants, also apply to the embodiment in FIGS. 3 and 4.

In a variant (not illustrated) of the latter embodiment, the auxiliary valve produces a pressure which is normally equal to the load-sensing pressure increased by a constant, the connection of the regulating chamber 308 to the conduit 102 being replaced by a connection to the conduit 74. In this case the detection of the highest of the pressures upstream of the throttle of the controlled spool can be eliminated, and the load-sensing pressure can be made to prevail in the chamber 86. It is also possible, depending on circumstances, to choose a regulating pressure other than MAX($P_i$) or the load-sensing pressure. In these variants, the advantages of the use of an auxiliary valve are retained.

More generally, many variations can be made to the examples described. In this regard, it should be stated that the invention is to be limited only by the scope of the appended claims.

What is claimed is:

1. A unit for controlling a plurality of hydraulic actuators supplied by a single flow-rate generator comprising a plurality of proportional directional valves, each hydraulic actuator of said plurality of hydraulic actuators being connected to said flow rate generator through a corresponding one of said proportional directional valves, each of said proportional directional valves comprising:

a controlled spool, the position of said controlled spool determining a cross section of a first throttle that makes a part of a connection between said flow rate generator and an actuator of said plurality of hydraulic actuators;

a compensating spool for regulating a pressure difference between upstream and downstream of said first throttle by producing, upstream, a second throttle with an appropriate cross section;

means for actuating said compensating spool, in order to cause said compensating spool to automatically adopt a position in which said compensating spool produces said second throttle with an appropriate cross section, in response to several pressures acting respectively in a direction of opening and in a direction of closing; and said unit further comprising means for detecting a highest of pressures prevailing upstream of said first throttle of said plurality of proportional directional valves and means for actuating said compensating spool, said actuating means responding to said highest of said detected upstream pressures and for controlling said compensating spool.

2. The unit according to claim 1, wherein said means for actuating said compensating spool biases said compensating spool toward a position of opening by the pressure downstream of said first throttle and by the pressure upstream of said second throttle and toward a position of closing by the pressure upstream of said first throttle, by said highest of the pressures upstream of said plurality of first throttles, and by a substantially constant biasing force;

whereby said unit is adaptable for use with said flow-rate generator producing a service pressure normally equal to a regulating, load-sensing pressure increased by a predetermined constant.

3. The unit according to claim 2, wherein each of said means for actuating said compensating spool comprises:

a first active surface subject to the pressure downstream of said first throttle;

a second active surface subject to the pressure upstream of said second throttle, a third active surface subject to the pressure upstream of said first throttle; and a fourth active surface subject to said highest of the pressures upstream of said plurality of first throttles, said first active surface positioned on said compensating spool in opposed relation to the position on said compensating spool of said fourth active surface and said second active surface positioned on said compensating spool in opposed relation to the position on said compensating spool of said third active surface; said means for actuating said compensating spool further comprising a spring biasing said compensating spool toward a closed position.

4. The unit according to claim 3, wherein said first and third active surfaces of said compensating spool have substantially similar sizes, and said second and fourth surfaces of said compensating spool have substantially similar sizes.

5. The unit according to claim 3, wherein said means for detecting the highest of the pressures upstream of said plurality of first throttles includes a common conduit closed at a first end and opening out into a reservoir through a restriction at a second end; and said proportional directional valve further comprises a non-return valve disposed at a position upstream of said first throttle and through which fluid passes from said position upstream of said first throttle and said common conduit.

6. The unit according to claim 5, wherein each of said proportional directional valves further comprises a stator body which includes conduits passing through it completely, whereby a series of proportional directional valves may be connected end to end and wherein said compensating spool further comprises said non-return valve disposed between said third active surface and said fourth active surface.

7. The unit according to claim 2, wherein each of said proportional directional valves lacks a non-return valve between said second throttle and said first throttle.

8. The unit according to claim 1, wherein said actuating means further comprises at least one auxiliary valve fed by said flow-rate generator, said at least one auxiliary valve producing a pressure which is equal to said highest of said detected pressures upstream of said plurality of first throttles increased by a predetermined constant; and wherein each of said actuating means bias said compensating spool toward a position of opening by the pressure downstream of each said first throttle and by the pressure produced by said at least one auxiliary valve, and toward a position of closing by the pressure upstream of each said first throttle, by said highest of the pressures upstream of each said first throttle and by a substantially constant biasing force.

9. The unit according to claim 8, wherein each of said means for actuating said compensating spool comprises:

a first active surface subject to the pressure downstream of said first throttle;

a second active surface subject to the pressure produced by said at least one auxiliary valve;

a third active surface subject to the pressure upstream of said first throttle; and a fourth active surface subject to said highest of the pressures upstream of said plurality of first throttles, said first active surface positioned on said compensating spool in opposed relation to the position on said compensating spool of said fourth active surface and said second active surface positioned on said compensating spool in opposed relation to the position on said compensating spool of said third active surface, said means for actuating said compensating spool further comprising a spring biasing said compensating spool toward a closed position.

10. The unit according to claim 9, wherein said first and third active surfaces of said compensating spool have substantially similar sizes, and said second and fourth active surfaces of said compensating spool have substantially similar sizes.

11. The unit according to claim 8, wherein said at least one auxiliary valve comprises:

an inlet chamber connected to said flow-rate generator;

a regulating chamber having a pressure equal to said highest of the pressures upstream of said plurality of first throttles;

an outlet chamber in which the pressure produced prevails;

a spool, the position of said spool determining the cross section of a third throttle between said inlet chamber and said outlet chamber, said spool having a first active surface disposed in said regulating chamber so that said highest of the pressures upstream of said plurality of first throttles acts in the direction of opening, and a second active surface disposed in said outlet chamber so that the pressure produced acts in the direction of closing; and a spring which acts on said spool in the direction of opening.

12. The unit according to claim 8, wherein a first group of said plurality of proportional directional valves has a common auxiliary valve adjacent to it and a second group of said plurality of proportional directional valves, relatively distant from said first group, has a common auxiliary valve adjacent to it.

13. The unit according to claim 8, wherein said unit is free of any non-return valve between said second throttle and said first throttle.

14. The unit according to claim 1 further comprising means for detecting a load-sensing pressure in the most loaded hydraulic actuator of said plurality of hydraulic actuators and communicating said load sensing pressure to said flow-rate generator.

15. The unit according to claim 14 wherein said load-detection means includes, for each of said proportional directional valves, a conduit which connects the upstream of said first throttle to at least one circuit selector, and in that, where there are several of them, said at least one circuit selector being disposed in a cascade.

16. The unit of claim 15 wherein a plurality of said circuit selectors are disposed in a cascaded array.

17. The unit according to claim 1, wherein each of said proportional directional valves further comprises a stator body which includes conduits which pass completely through it, whereby a series of proportional directional valves may be connected end to end.

* * * * *

UNITED STATES PATENT AND TRADEMARK OFFICE

CERTIFICATE OF CORRECTION

PATENT NO. : 5,415,199

DATED : 5/16/95

INVENTOR(S) : Jean-Louis Claudinon and Andre Roussett

It is certified that error appears in the above-indentified patent and that said Letters Patent is hereby corrected as shown below:

Column 4, line 24, delete "where" insert ---- Where ----.

Column 6, line 34, delete "it" first occurrence, insert ---- is ----.

Column 7, line 62, delete ---- for ----.

Column 8, line 22, delete "86" insert ---- 86' ----.

Column 8, line 56, delete "$b = \frac{S_1}{S_2} a - \frac{F}{S_2}$" insert ---- $b = \frac{S_1}{S_2} a - \frac{F}{S_2}$ ----.

Column 12, between lines 7 and 8, delete paragraph indentation.

Column 12, between lines 10 and 11, delete paragraph indentation.

Column 12, between lines 14 and 15, delete paragraph indentation.

UNITED STATES PATENT AND TRADEMARK OFFICE

CERTIFICATE OF CORRECTION

PATENT NO. : 5,415,199
DATED : 5/16/95
INVENTOR(S) : Jean-Louis Claudinon and Andre Roussett It is certified that error appears in the above-indentified patent and that said Letters Patent is hereby corrected as shown below:

Column 12, line 24, delete "," insert ---- ; ----.

Column 14, line 29, delete "load sensing" insert ---- load-sensing ----.

Signed and Sealed this

First Day of August, 1995

Bruce Lehman

*Attest:*

BRUCE LEHMAN

*Attesting Officer*

*Commissioner of Patents and Trademarks*